US007066751B2

(12) United States Patent
Chen

(10) Patent No.: US 7,066,751 B2
(45) Date of Patent: Jun. 27, 2006

(54) ADJUSTABLE CONNECTOR MODULE

(75) Inventor: Yi-Jen Chen, Taipei Hsien (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 10/829,210

(22) Filed: Apr. 22, 2004

(65) Prior Publication Data

US 2004/0214463 A1 Oct. 28, 2004

(30) Foreign Application Priority Data

Apr. 23, 2003 (TW) ..... 92109515 A
Jun. 27, 2003 (TW) ..... 92117664 A

(51) Int. Cl.
*H01R 13/64* (2006.01)

(52) U.S. Cl. ..... 439/247; 439/66

(58) Field of Classification Search ..... 439/66, 439/78, 81, 83, 91, 247, 248, 573, 591
See application file for complete search history.

(56) References Cited

U.S. PATENT DOCUMENTS 3,271,627 A * 9/1966 McDougal ..... 361/776
3,796,986 A * 3/1974 Tamburro ..... 439/329
5,161,985 A * 11/1992 Ramsey ..... 439/74

* cited by examiner

*Primary Examiner*—Khiem Nguyen
(74) *Attorney, Agent, or Firm*—Birch, Stewart, Kolasch & Birch, LLP

(57) ABSTRACT

An adjustable connector is electrically connected with corresponding signal contacts on a circuit board by a multiple of leaf springs. As a result of the flexibility of the leaf springs, the adjustable connector can move within a small range in relation to the circuit board while keeping in electrical connection with the circuit board so as to adjust the position of the adjustable connector on the circuit board.

7 Claims, 16 Drawing Sheets

ADJUSTABLE CONNECTOR MODULE

This Nonprovisional application claims priority under 35 U.S.C. § 119(a) on Patent Application No(s). 092109515 and 092117664 filed in TAIWAN on Apr. 23, 2003 and Jun. 27, 2003, the entire contents of which are hereby incorporated by reference.

FIELD OF THE INVENTION

The present invention relates to an adjustable connector module and, more specifically, to a connector connected to a circuit board with leaf springs such that the connector can move on the circuit board in a small range to facilitate combination of the connector with corresponding pins of a peripheral component.

BACKGROUND OF THE INVENTION

With rapid advancement of fabrication of integrated circuits, the electronic technology makes continuous development and progress so that a new generation of chipsets and processors can have more sophisticated interior circuit frames to provide powerful arithmetical ability and more complex operating functions. In particular, they can easily process digital information such as a variety of sounds, images and graphics, and therefore are greatly applied in multimedia electronic products which are preferred and broadly used by consumers.

PlayStation 2 (PS 2) is currently the popular game player since it can provide delicate and smooth pictures with design of the Emotion Engine fabricated by the process and the Graphics Synthesizer. In order to improve the performance of the game players, the related manufacturers continuously produce various peripheral devices to provide more operating functions and options. In particular, since online games are in vogue, the manufacturers in turn provide the game players with peripheral products to connect to the Internet. For the PS 2 game player, consumers can purchase a box-like modem and connect it to the backside panel of the game player through a connector. Hence, through such a modem, the PS 2 game player can either be connected to the Internet or perform a network connection game.

Please refer to FIG. 1, which is a schematic perspective diagram of a conventional modem 1 for the PS 2 game player. The box-like modem 1 has three connectors 11, 12 and 13 respectively in signal and electrical connection with a motherboard (not shown) and a hard disc 2 of the game player when assembled to the backside of the game player. As shown in FIG. 1, the connector 11 at the upper portion of the modem 1 is used to connect with the motherboard for transmission of command and information. The connectors 12 and 13 at the lower portion of the modem 1 are used to connect with the hard disc 2 of the game player. The signal connector 12 is combined to signal pins 22 at the backside of the hard disc 2 for transmission of signals and information. The power connector 13 is combined to power pins 23 at the backside of the hard disc 2 for receiving electricity.

In order to enhance hardware compatibility, a certain of specifications of the hard disc for the PS 2 game player are rigidly delimited. For instance, the distance between the signal pins 22 and the power pins 23 has not be standardized. All sorts of hard discs produced by various manufacturers can be used in the PS 2 game player. However, the specifications of hard discs are not uniform, the modem accompanying the PS 2 game player is hard to be assembled thereto. Particularly, the hard disc 2 when assembled to the PS 2 game player may be firmly fastened onto the left side of the housing of the game player or onto the right side of the housing thereof, and also the distance between the signal pins 22 and the power pins 23 of the hard disc 2 produced by each manufacturer is not the same. Therefore, it is troublesome for the manufacturers of PS 2 game players to determine the relative positions of the connectors 11, 12 and 13 of the modem 1.

To solve the alignment of the connectors 11, 12 and 13, in addition that the connector 11 in the conventional modem 1 for connecting with the motherboard is fixed, the signal connector 12 and the power connector 13 for connecting with the hard disc 2 are designed to be movable right and left at a small distance so as to facilitate adjustment of alignment due to the specification differences of the hard discs of various brands. In such a design, the connectors 11, 12 and 13 are respectively fabricated on three different circuit boards. Quite a lot of components are required, and thus not only do production costs increase, but also the complex assembling prolongs the whole producing cycle and results in unfavorable throughput.

Referring to FIG. 2 and FIG. 3, internal constructions of the conventional connectors in the modem 1 are illustrated. As mentioned in the above, since the connectors 11, 12 and 13 are respectively fabricated on the three different circuit boards, an additional fixed frame 15 is required for the housing of the modem 1 to keep each of the circuit boards firmly fastened thereon and then the fixed frame 15 is assembled to an outer case 17 of the modem 1. FIG. 2 shows the components required to assemble the signal connector 12 onto the fixed frame 15. The connector 11 for connecting with the motherboard of the game player is directly fixed on a main circuit board 110 by the surface mount technology (SMT). As shown in FIG. 2, the main circuit board 110 has a larger size than the others and is slightly smaller than the fixed frame 15 such that it can be fittedly fastened in the space embraced by the sidewall of the fixed frame 15.

The signal connector 12 is fixed on a circuit board 120 of smaller size by SMT or dual in-line package (DIP). A plate 121 is located at the bottom of the circuit board 120. The right and left ends of the plate 121 have a respective rivet 121*a*. Two fastening screws 122*a* are used to respectively pass through holes at the two ends of the signal connector 12 and the circuit board 120 in turn to be firmly screwed onto the rivets 121*a* of the plate 121 so as to lock these three components together. Furthermore, two ends near the center of the plate 121 have a respective rivet 121*b* corresponding to holes 151 at an edge plate of the fixed frame 15 below the plate 121. Similarly, two fastening screws 122*b* are used to respectively pass through the holes 151 upward from the bottom of the edge plate of the fixed frame 15 to be firmly screwed onto the rivets 121*b* of the plate 121 so as to lock the plate 121 onto the edge plate of the fixed frame 15. Since the hole 151 is oval, the plate 121 can move in a small range when locked such that the relative position of the signal connector 12 to the fixed frame 15 can be slightly adjusted.

In order that the signal connector 12 can be adjusted, assembling and material costs are raised because the circuit board 120 for the signal connector 12 is extra fabricated and the fixed frame 15, the plate 121, the rivets 121*a* and 121*b* as well as the fastening screws 122*a* and 122*b* are additionally required. Moreover, in order to electrically connect the circuit board 120 on which the signal connector 12 is located with the main circuit board 110, busline connections 110*a* and 120*a* are respectively mounted on the main circuit board 110 and the circuit board 120 so as to connect both of them through a flexible flat cable (FFC) 123. In such a way, it results in additional costs of two busline connections and a flexible flat cable and more complicated assembling.

Similarly, the design of the power connector 13 is also complicate. FIG. 3 shows the assembling of the power connector 13 onto the fixed frame 15. Another circuit board 130 of smaller size is extra fabricated to combine with the power connector 13. Moreover, another plate 131 is located at the bottom of the circuit board 130. The right and left ends of the plate 131 have a respective rivet 131*a*. Two fastening screws 132*a* are used to respectively pass downward as shown in FIG. 3 through holes of the power connector 13 and the circuit board 130 in turn to be firmly screwed onto the rivets 131*a* of the plate 131 so as to lock these three components together. Furthermore, the center of the plate 131 has a rivet 131*b* corresponding to a hole 152 at the edge plate of the fixed frame 15 below the plate 131. A fastening screw 132*b* is used to pass through the hole 152 upward from the bottom of the edge plate of the fixed frame 15 to be firmly screwed onto the rivets 131*b* of the plate 131 so as to lock the plate 131 onto the edge plate of the fixed frame 15. Since the diameter of the hole 152 is larger than needed, the plate 131 can move in a small range such that the position of the power connector 13 can be adjusted.

In order to electrically connect the circuit board 130 on which the power connector 13 is located with the main circuit board 110, power connections 110*b* and 130*a* are respectively mounted on the main circuit board 110 and the circuit board 130 so as to connect both of them through a power cable 133. However, such a design requires the extra circuit board 130 for the power connector 13, the fixed frame 15, the plate 131, the rivets 131*a* and 131*b*, the fastening screws 132*a* and 132*b*, the power connections 110*b* and 130*a* as well as the power cable 133. Hence, assembling and material costs are also raised and the assembling procedure is more complicated.

SUMMARY OF THE INVENTION

The first objective of the present invention is to provide a design of fabricating several adjustable connectors on one main circuit board, in which the position of each of the adjustable connectors can be adjusted in a small range.

The second objective of the present invention is to provide a design of fabricating an adjustable connector and an immovable connector on one main circuit board, in which the adjustable connector can move in a small range to adjust the position of the adjustable connector in relation to the main circuit board.

The third objective of the present invention is to provide an adjustable connector connected to a main circuit board by leaf springs.

In a first embodiment of this invention, an adjustable connector is disclosed to electrically connect with corresponding signal contacts on a circuit board by a multiple of leaf springs. The bottom surface of the adjustable connector has a plurality of grooves and each groove has a leaf spring therein. When the adjustable connector is assembled to the circuit board, the tip of each leaf spring just press against the corresponding signal contact on the circuit board to have an electrical connection. An end of the adjustable connector has an opening through which a fastening screw can pass to delimit the adjustable connector on the circuit board. As a result of the flexibility of the leaf springs, the adjustable connector can move within a small range in relation to the circuit board while keeping in electrical connection with the circuit board so as to adjust the position of the adjustable connector on the circuit board.

Furthermore, an adjustable connector module assembled on to a circuit board is provided in a second embodiment of this invention. The circuit board has a plurality of pads for electrically connecting with the adjustable connector module. The adjustable connector module comprises a leaf spring connector and an adjustable signal connector. The bottom surface of the leaf spring connector has a plurality of first pins firmly soldered to the plurality of pads and the top surface thereof has a plurality of leaf springs correspondingly electrically connected with said a plurality of first pins via interconnections. The bottom surface of the adjustable signal connector has a plurality of second pins against which the plurality of leaf springs correspondingly press to electrically connect the adjustable signal connector with the leaf spring connector. The two ends of the adjustable signal connector have a respective opening through which a fastening screw can pass to delimit the adjustable signal connector on the circuit board. The adjustable signal connector can keep in electrical connection with the leaf spring connector as a result of the flexibility of the plurality of leaf springs, when the adjustable signal connector makes a small movement in relation to the circuit board.

In a third embodiment of this invention, an adjustable connector module assembled onto a circuit board having a plurality of pads comprises an adjustable connector, a wing portion and a frame. The adjustable connector is placed on the circuit board and a plurality of leaf springs corresponding to the pads are located at the surface of the adjustable connector contacting with the circuit board to produce electrical connection. The wing portion is connected with the adjustable connector. The frame has an opening whose size is greater than that of the adjustable connector and slightly smaller than that of the wing portion. That fame is fixed on the circuit board, the wing portion is located within the frame and the adjustable connector is through the opening.

In a fourth embodiment of this invention, an adjustable connector module assembled onto a circuit board comprises a bottom plate, an adjustable connector and a frame. A plurality of pins at the bottom surface of the bottom plate are fixed onto the circuit board and a plurality of pads at the top surface of the bottom plate are respectively connected to the corresponding pins through interconnections. The adjustable connector is placed on the bottom plate and a plurality of leaf springs corresponding to the pads are located at the bottom surface of the adjustable connector to produce electrical connection. The frame sleeves the adjustable connector and is fixed on the bottom plate to prevent the adjustable connector from escaping from the bottom plate. A gap exists between the adjustable connector and the frame.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

In this invention, a manner of connecting the signal connector onto the circuit board by leaf springs is disclosed. The signal connector is electrically connected with the corresponding signal contacts on the circuit board by a multiple of leaf springs, and as a result of the flexibility of the leaf spring, the signal connector can move within a small range in relation to the circuit board while keeping in electrical connection with the circuit board so as to adjust the position of the signal connector on the circuit board. Moreover, the adjustable signal connector and the adjustable power connector of this invention can be fabricated on the same circuit board. The detailed description of the present invention is given by the following best modes for illustration.

Figure 1:
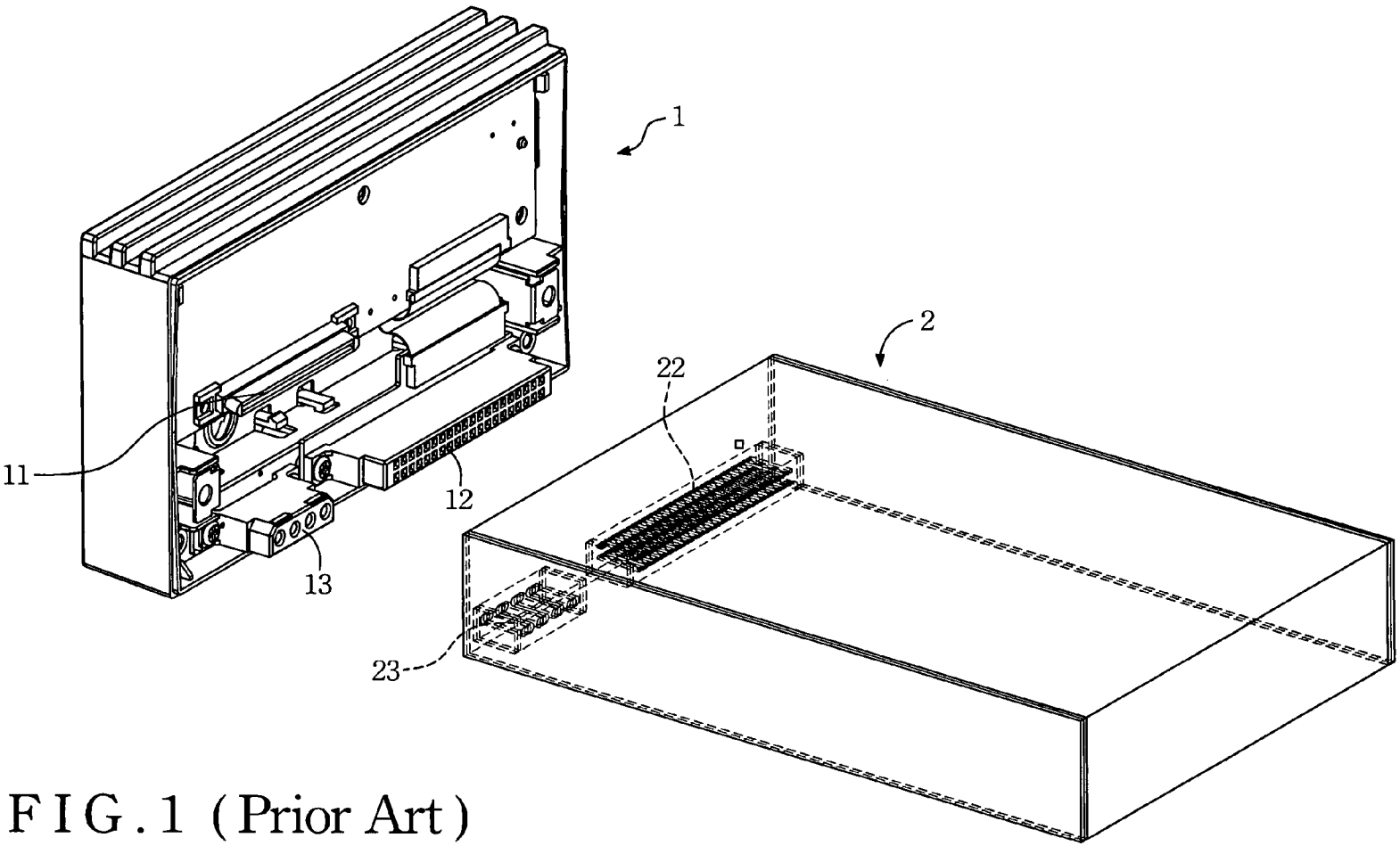
FIG. 1 (Prior Art)
FIG. 1 is a schematic perspective diagram of a conventional modem for a PS 2 game player, wherein the main connector, the signal connector and the power connector are respectively fabricated on three different circuit boards.
Figure 2:
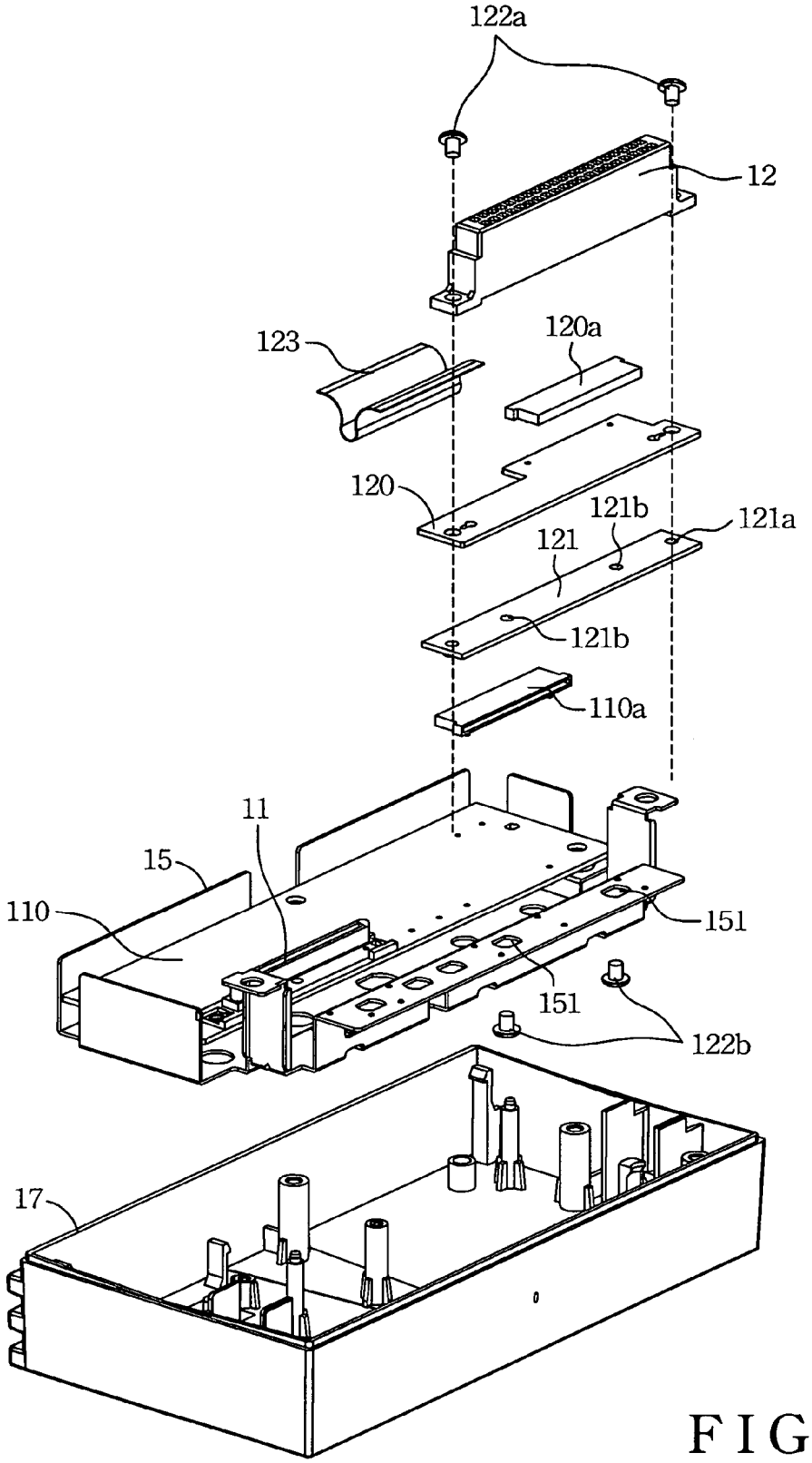
FIG. 2 (Prior Art)
FIG. 2 is a schematic exploded diagram of assembling the signal connector onto the fixed frame in the prior art.
Figure 3:
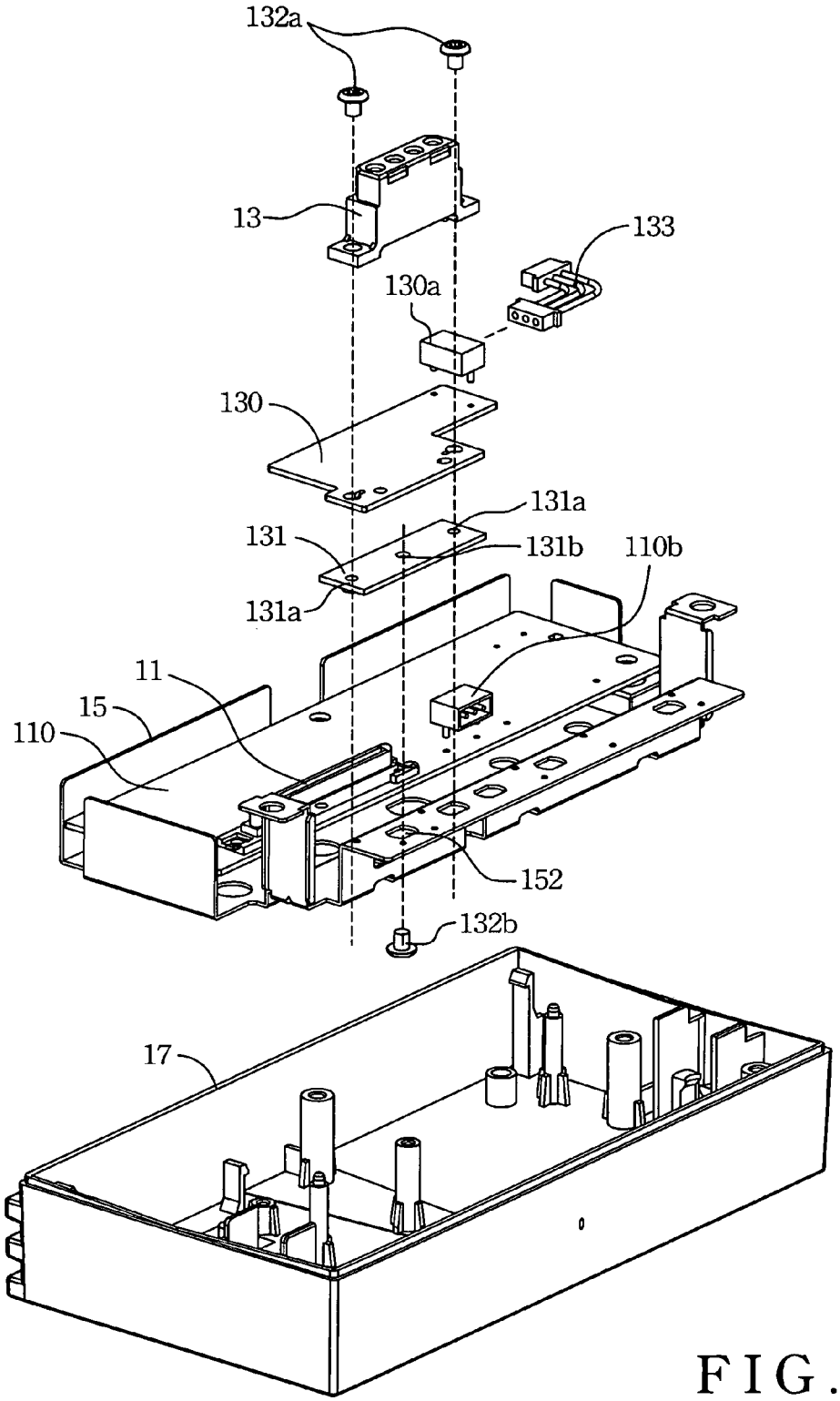
FIG. 3 (Prior Art)
FIG. 3 a schematic exploded diagram of assembling the power connector onto the fixed frame in the prior art.
Figure 4:
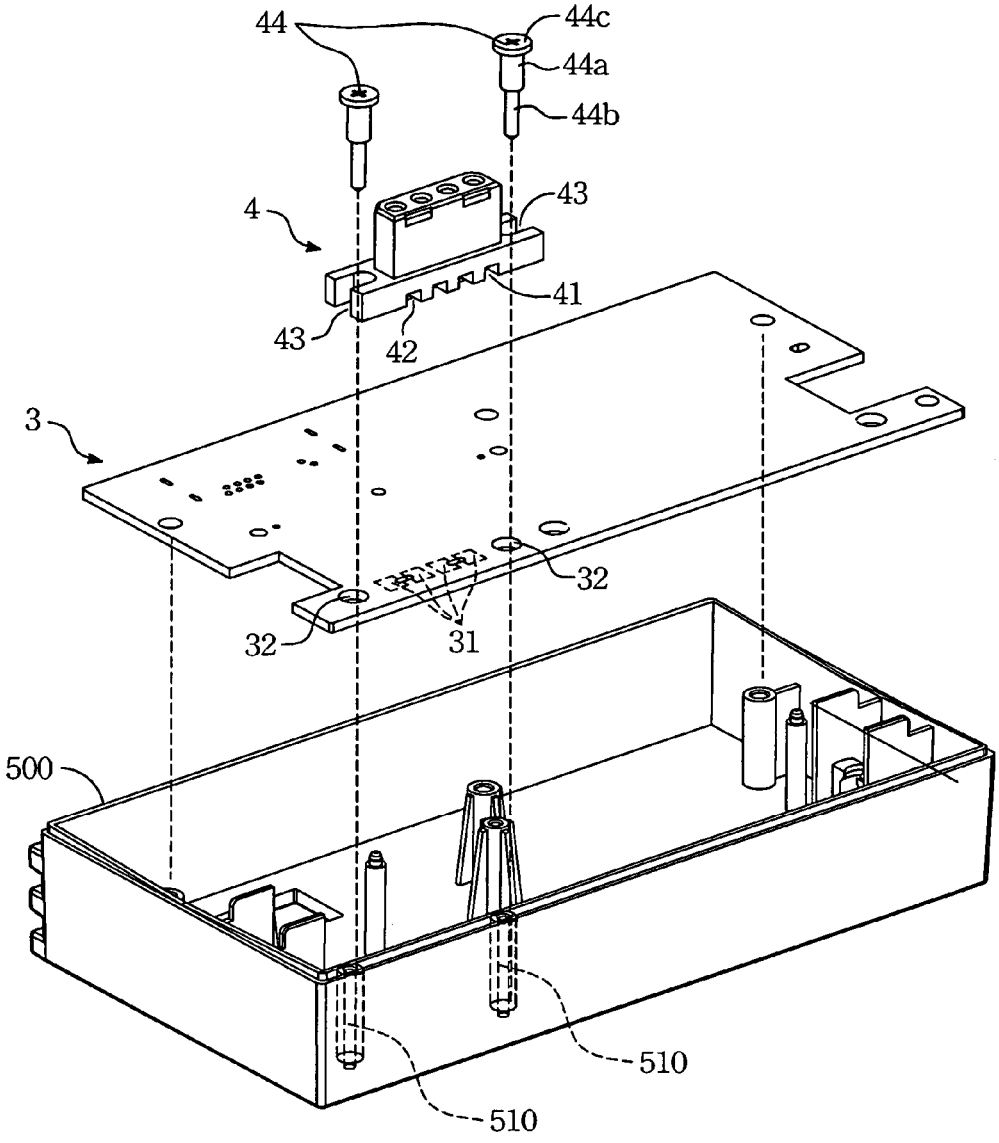
FIG. 4 is a schematic exploded diagram of an adjustable connector fabricated on a circuit board in accordance with a first embodiment of this invention.

Please refer to FIG. 4, which is a schematic exploded diagram of an adjustable connector 4 fabricated on a circuit board 3 in a first embodiment of this invention. This adjustable connector 4 is a power connector which is used to connect with the power pins at the backside of the hard disc for supplying power. A plurality of grooves 41 are located at the bottom surface of the adjustable connector 4, and a respective leaf spring 42 is mounted in each of the grooves 41. When the adjustable connector 4 is assembled onto the circuit board 3, each leaf spring 42 just presses against a corresponding pad 31 on the circuit board 3 to electrically connect the adjustable connector 4 with the circuit board 3.

Furthermore, the two ends of the adjustable connector 4 have one respective opening 43, such as a circular opening or a "U" shape opening (as shown in FIG. 4). When assembling the adjustable connector 4 onto the circuit board 3, two fastening screws 44 respectively pass through the "U" shape openings 43 to be respectively limited into corresponding tapped holes 32 on the circuit board 3 so as to fix the adjustable connector 4 onto the circuit board 3.

Particularly, the fastening screw 44 comprises an upper head 44*c*, a middle shank portion 44*a* and a lower threaded portion 44*b*. The diameter of the arc portion of the "U" shape opening 43 is smaller than that of the head 44*c* but larger than that of the shank portion 44*a*. The length of the shank portion 44*a* is longer than the thickness of the "U" shape opening 43. When fastening, the threaded portion 44*b* is rotated through the tapped holes 32 of the circuit board 3 into a corresponding tapped hole 510 on an outer frame 500 of the modem so as to lock the circuit board 3 to the outer frame 500. Since the diameter of the shank portion 44*a* is smaller that that of the arc portion of the "U" shape opening 43, the adjustable connector 4 can move horizontally in relation to the circuit board 3 rather than to be firmly locked onto the circuit board 3. In addition, because the length of the shank portion 44*a* is longer than the thickness of the "U" shape opening 43, the adjustable connector 4 can move vertically in relation to the circuit board 3. Furthermore, the adjustable connector 4 can also make a slight twist movement clockwise or counterclockwise on the circuit board 3.

When the adjustable connector 4 makes a small movement in relation to the circuit board 3, each leaf spring 42 can still keep close contact with the corresponding pad 31 on the circuit board 3 as result of its flexibility so as to allow the position of the adjustable connector 4 to be horizontally, vertically and even clockwise/counterclockwise adjusted on the circuit board 3 with maintenance of electrical connection.

Figure 5:
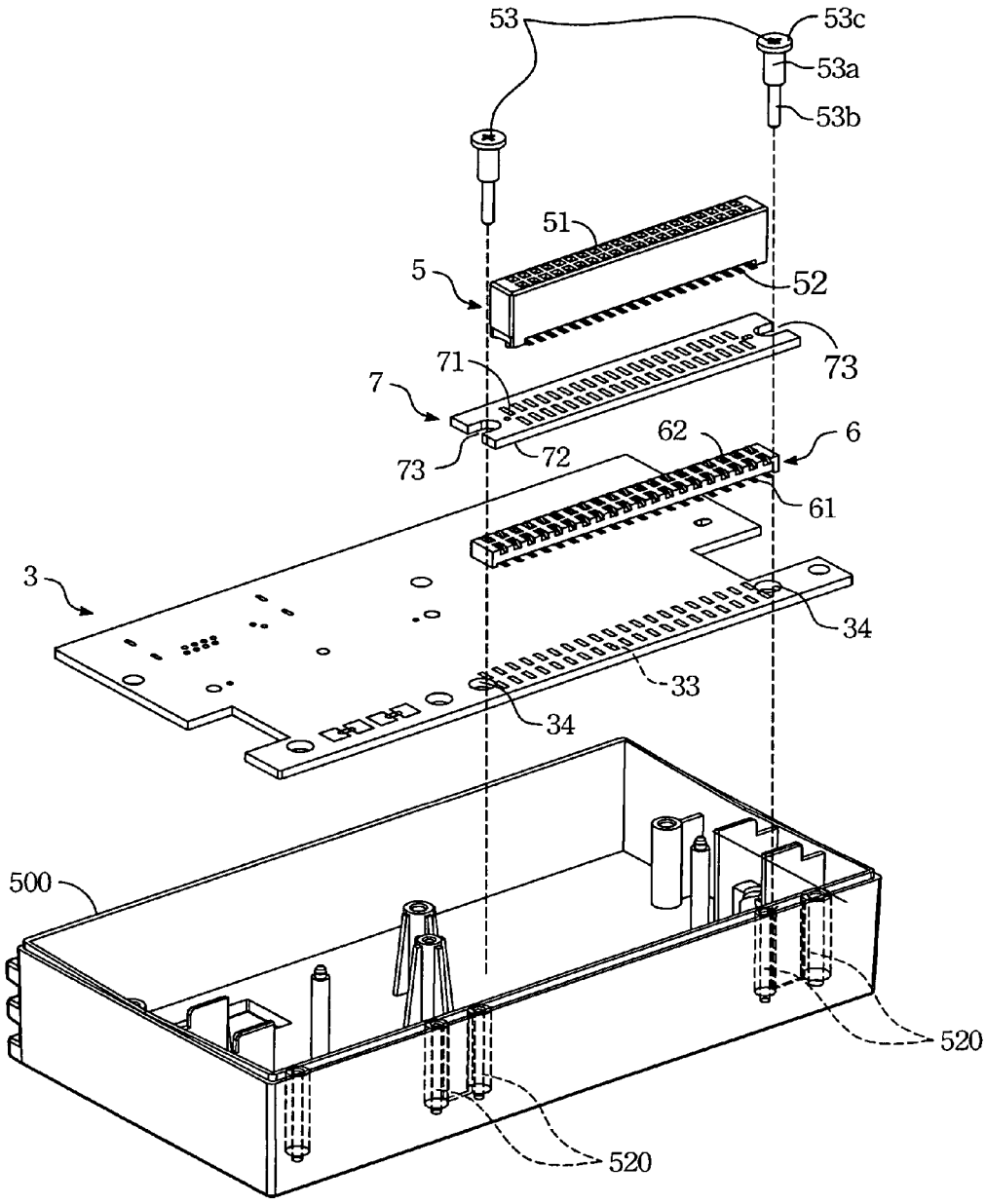
FIG. 5 is a schematic exploded diagram of an adjustable connector module fabricated on a circuit board in accordance with a second embodiment of this invention.

The design of electrical connection by leaf springs provided in this invention can also be employed in connectors with dense pins, such as the signal connector. Refer to FIG. 5, which is a schematic exploded diagram of an adjustable connector module fabricated on the circuit board 3 in a second embodiment of this invention. This adjustable connector module includes a signal connector 5 with dense pins, which is used to connect with the signal pins at the backside of the hard disc for transmission of desired signals and information, a leaf spring connector 6 and an optional circuit transferring plate 7. A plurality of pins 61 such as SMT pins, respectively corresponding to a plurality of pads 33 on the circuit board 3 are located at the bottom surface of the leaf spring connector 6. A plurality of densely arranged leaf springs 62 are mounted on the top surface of the leaf spring connector 6. These leaf springs 62 are respectively connected with corresponding pins 61 at the bottom surface of the leaf spring connector 6 through interconnections. The leaf spring connector 6 can be fixed onto the circuit board 3 by soldering so that the SMT pins 61 at the bottom surface thereof are directly electrically connected to the corresponding pads 33. Alternatively, the plurality of pins 61 are located at the top surface of the leaf spring connector 6 and the plurality of leaf springs 62 are mounted on the bottom surface thereof.

Figure 5A:
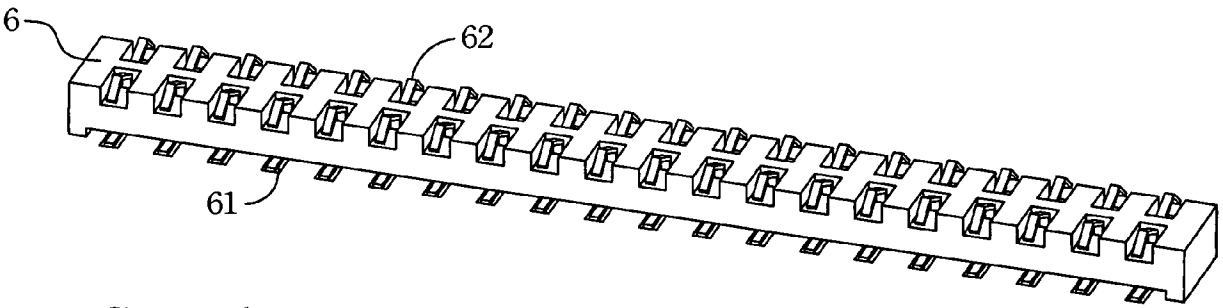
FIGS. 5A and 5B respectively show the top surface and the bottom surface of the leaf spring connector in the second embodiment of this invention.
Figure 5B:
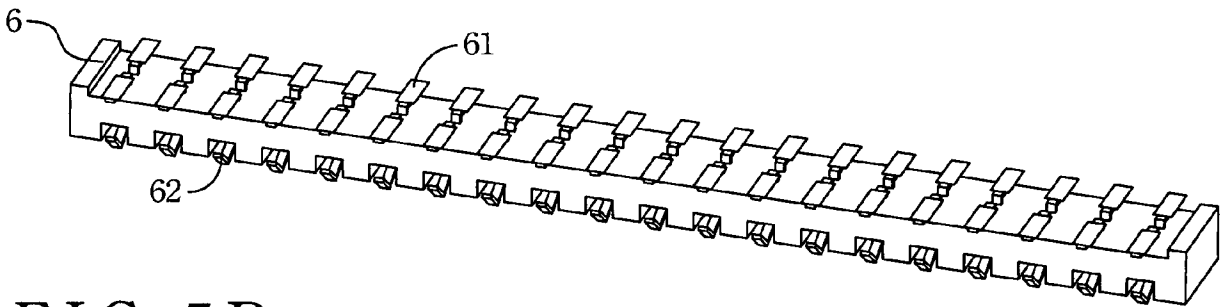

The detailed structure of the leaf spring connector 6 is illustrated in FIGS. 5A and 5B. FIG. 5A shows the plurality of densely arranged leaf springs 62 which are fabricated on the top surface of the leaf spring connector 6. FIG. 5B shows the plurality of SMT pins 61 which are fabricated on the bottom surface of the leaf spring connector 6 to connect with the pads 33 on the circuit board 3.

As shown in FIG. 5, a plurality of densely arranged small insertions 51 are located at the top surface of the signal connector 5 to connect with the signal pins at the backside of the hard disc. A plurality of densely arranged pins 52 are located at the bottom surface of the signal connector 5 and are connected to the corresponding insertions 51 through the interconnections of the signal connector 5. When assembling the adjustable connector module, the signal connector 5 can be directly pressed to the top surface of the leaf spring connector 6. At this time, the tip of each leaf spring 62 of the leaf spring connector 6 just presses against the corresponding pin 52 to electrically connecting the signal connector 5 with the leaf spring connector 6. Under such condition, the signal connector 5 is allowed to make a small movement horizontally and vertically in relation to the circuit board 3 as a result of the flexibility of the leaf spring 62.

Since the pins 52 of the signal connector 5 are of small size and densely arranged, the leaf springs 62 of the leaf spring connector 6 of larger size are difficult to be densely arranged as the pins 52. Hence, the optional circuit transferring plate 7 is used. As shown in FIG. 5, a plurality of densely arranged first pin patterns 71 are located at the top surface of the circuit transferring plate 7 and a plurality of less densely arranged second pin patterns 72 are located at the bottom surface of the circuit transferring plate 7. The first pin patterns 71 have of smaller size than the second pin patterns 72 and have the same space arrangement as the pins 52 of the signal connector 5. Hence, the circuit transferring plate 7 can be directly attached to the bottom surface of the signal connector 5 to have each first pin pattern 71 connected to the corresponding pin 52. Similarly, the second pin patterns 72 have the same space arrangement as the leaf springs 62 of the leaf spring connector 6, and thus when attached to the top surface of the leaf spring connector 6, each second pin pattern 72 is just in contact with the corresponding leaf spring 62.

Furthermore, the two ends of the circuit transferring plate 7 have one respective "U" shape opening 73 through which a fastening screw 53 passes to lock the circuit transferring plate 7 onto the circuit board 3. When assembling, the signal connector 5 is firstly fixed on the top surface of the circuit transferring plate 7 by soldering to have the desired electrical connection. Also, the leaf spring connector 6 is fixed on the circuit board 3 by soldering to have the desired electrical connection. Then, the two fastening screws 53 respectively pass through the "U" shape openings 73 to be respectively locked to corresponding tapped holes 34 on the circuit board 3 so as to fix the signal connector 5 and the circuit transferring plate 7 onto the circuit board 3. At this time, the tip of each leaf spring 62 at the top surface of the leaf spring connector 6 just presses against each second pin pattern 72 at the bottom surface of the circuit transferring plate 7 to have the desired electrical connection.

The fastening screw 53 comprises an upper head 53*c*, a middle shank portion 53*a* and a lower threaded portion 53*b*. The diameter of the arc portion of the "U" shape opening 73 is smaller than that of the head 53*c* but larger than that of the shank portion 53*a*. The length of the shank portion 53*a* is longer than the thickness of the "U" shape opening 73. When fastening, the threaded portion 53*b* is rotated through the tapped holes 34 of the circuit board 3 into a corresponding tapped hole 520 on the outer frame 500 of the modem so as to lock the circuit board 3 to the outer frame 500. Hence, the signal connector 5 can move vertically in relation to the circuit board 3 or the circuit transferring plate 7. Furthermore, the signal connector 5 can move horizontally in relation to the circuit board 3.

Figure 6:
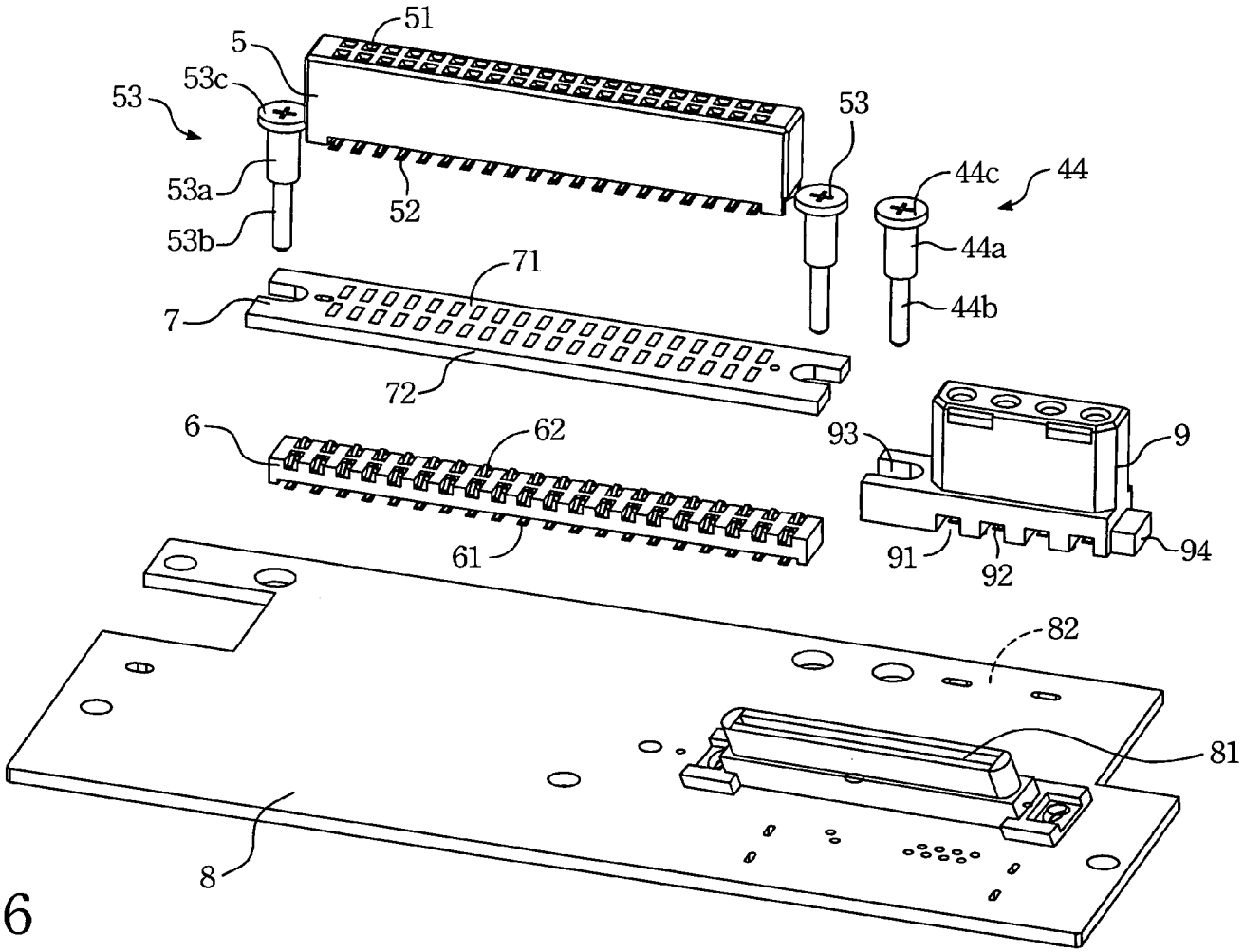
FIG. 6 is a schematic exploded diagram showing an adjustable signal connector and an adjustable power connector respectively fabricated on a main circuit board in accordance with a third embodiment of this invention.

Referring to FIG. 6, a third embodiment of an adjustable signal connector together with an adjustable power connector fabricated on one main circuit board 8 according to this invention is illustrated. In addition to an adjustable signal connector 5 and an adjustable power connector 9 for respectively connecting with signal pins and power pins at the backside of a hard disc, a traditional immovable connector 81 for electrically connecting with a motherboard is also mounted on the circuit board 8. The connections of the signal connector 5, the circuit transferring plate 7 and the leaf spring connector 6 in FIG. 6 is the same as the embodiment of FIG. 5. The connection of the power connector 9 is similar to the embodiment of FIG. 4. Leaf springs 92 in the grooves 91 at the bottom surface of the power connector 9 press against corresponding pads 82 at the top surface of the circuit board 8 to have desired electrical connection.

Particularly, one end of the power connector 9 has one "U" shape opening 73 and the other end thereof has a protruder 94. When assembling the circuit board 8 into the frame or housing of the modem (not shown), the protruder 94 can be just built into a channel (not shown) formed by the circuit board 8 and the frame of the modem. A fastening screw 44 is used to pass through the "U" shape opening 93 to be limited into a corresponding tapped hole on the circuit board 8 so as to lock the power connector 9 onto the circuit board 8. At this time, the tip of each leaf spring 92 at the bottom surface of the 1 power connector 9 just presses against each corresponding pad 82 at the top surface of the circuit board 8 to have the desired electrical connection. By adjusting the position of the fastening screw 44 in the "U" shape opening 93, the power connector 9 can make a small movement in relation to the circuit board 8.

Figure 7:
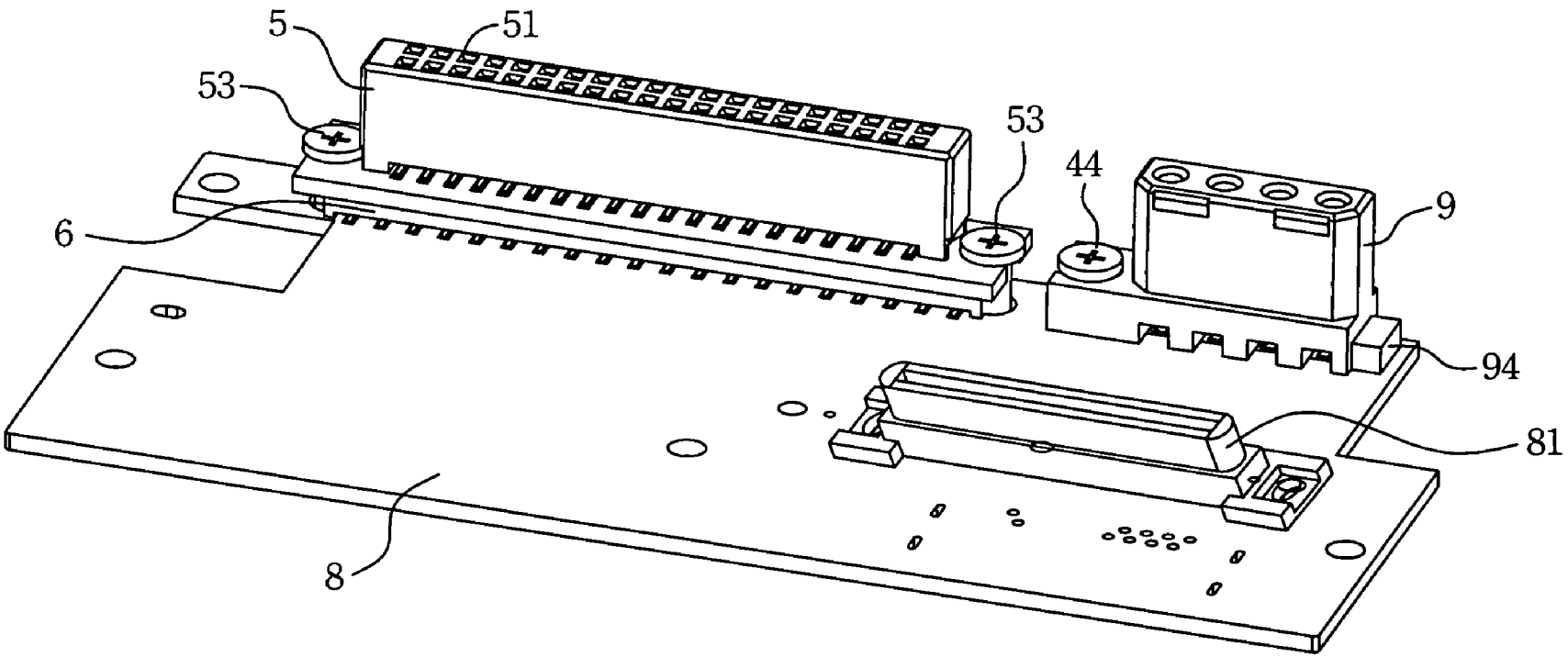
FIG. 7 is a schematic perspective diagram of assembling the signal connector, the circuit transferring plate, the leaf spring connector and the power connector onto the main circuit board in accordance with this invention.
Figure 8A:
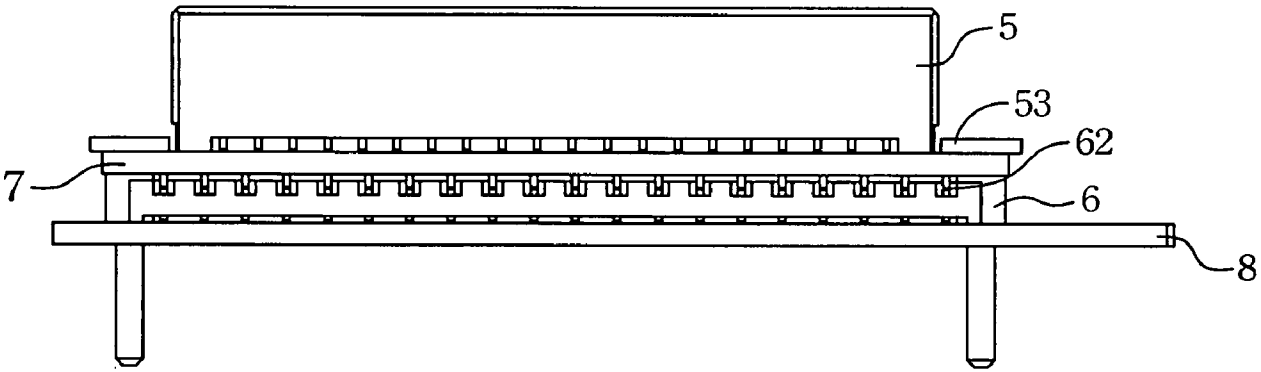
FIGS. 8A and 8B are respectively side views of the signal connector and the power connector assembled on the main circuit board in accordance with this invention.
Figure 8B:
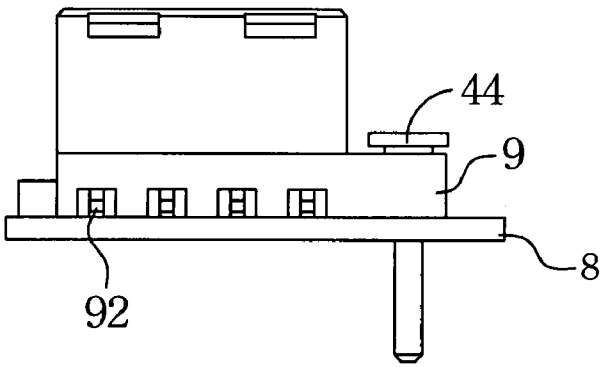

FIG. 7 shows that the signal connector 5, the circuit transferring plate 7, the leaf spring connector 6 and the power connector 9 have been assembled onto the circuit board 8. FIGS. 8A and 8B are respectively the side views of the signal connector 5 and the power connector 9 assembled on the circuit board 8. The signal connector 5 is firmly soldered onto the circuit transferring plate 7 and is limited onto the top surface of the leaf spring connector 6 by the fastening screws 53 and can be horizontally or vertically adjusted in a small range on the leaf spring connector 6 so as to change the position of the signal connector 5 in relation to the circuit board 8. The power connector 9 is limited onto the circuit board 8 by the protruder 94 and the fastening screw 44 and can also be horizontally or vertically adjusted in a small range on the circuit board 8.

Furthermore, in accordance with a fourth embodiment of this invention, a frame is put through an adjustable connector having leaf springs and is fixed onto a circuit board so as to effectively constrain the adjustable connector and to prevent it from separating from the circuit board. Please refer to FIG. 9, which is a schematic exploded diagram of an adjustable connector module 5' fabricated on a circuit board 3' in the fourth embodiment of this invention. The adjustable connector module 5' comprises an adjustable connector 50 and a frame 52'.

During assembling, the adjustable connector 50 is directly placed on the circuit board 3'. A plurality of leaf springs (not shown) mounted on the bottom surface of the adjustable connector 50 just press against a plurality of corresponding pads 30 on the circuit board 3' to electrically connect the adjustable connector 50 with the circuit board 3'.

The frame 52' for constraining the adjustable connector 50 may be put downward through the adjustable connector 50 and fixed onto the circuit board 3' so as to prevent the adjustable connector 50 from separating from the pads 30 of the circuit board 3'.

Figure 9:
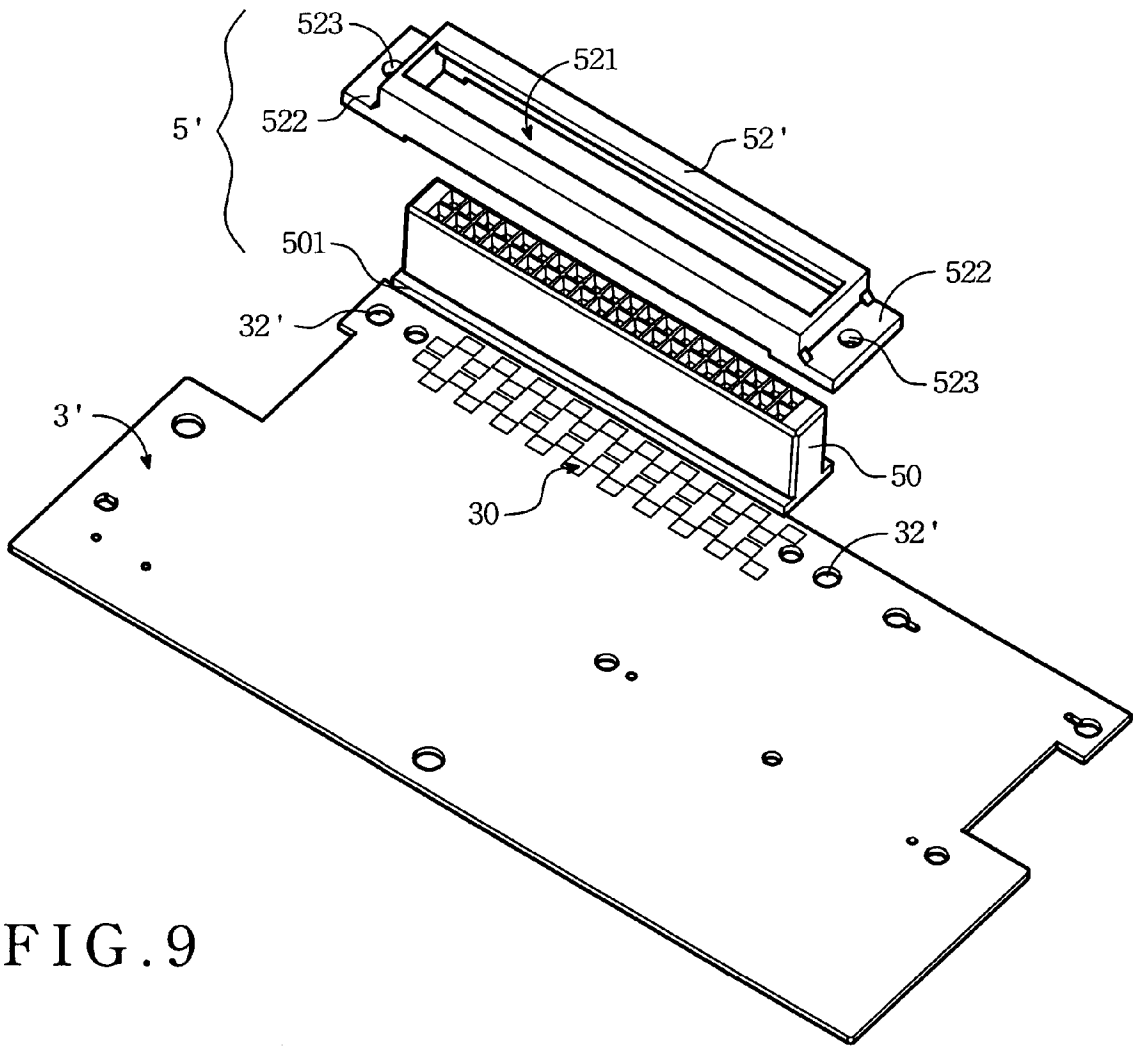
FIG. 9 is a schematic exploded diagram of an adjustable connector module fabricated on a circuit board in accordance with a fourth embodiment of this invention.

As shown in FIG. 9, the frame 52' has an opening 521 of rectangular shape and of size greater than that of the adjustable connector 50 to facilitate the displacement of the adjustable connector 50 sleeved by the frame 52' in the opening 521 with respect to the circuit board 3'. After assembling, a gap is formed between the adjustable connector 50 and the frame 52' such that the adjustable connector 50 can move within the frame 52' relative to the circuit board 3' while maintaining the electrical connection with the circuit board 3' so as to adjust the relative position of the adjustable connector 50 on the circuit board 3'.

Furthermore, a wing portion 501 extending from the lower part of the long side wall of the adjustable connector 50 is fabricated to prevent the adjustable connector 50 from escaping through the opening 521 of the frame 52'. When the frame 52' sleeves the adjustable connector 50, it locks in the wing portion 501 mounted at the two sides of the adjustable connector 50 so as to prevent the adjustable connector 50 from escaping from the circuit board 3'.

A respective plate 522 extends from the two ends of the frame 52' and has a tapped hole. When the frame 52' sleeves the adjustable connector 50 and is assembled onto the circuit board 3', the frame 52' can be locked onto the circuit board 3' by screws.

Figure 10:
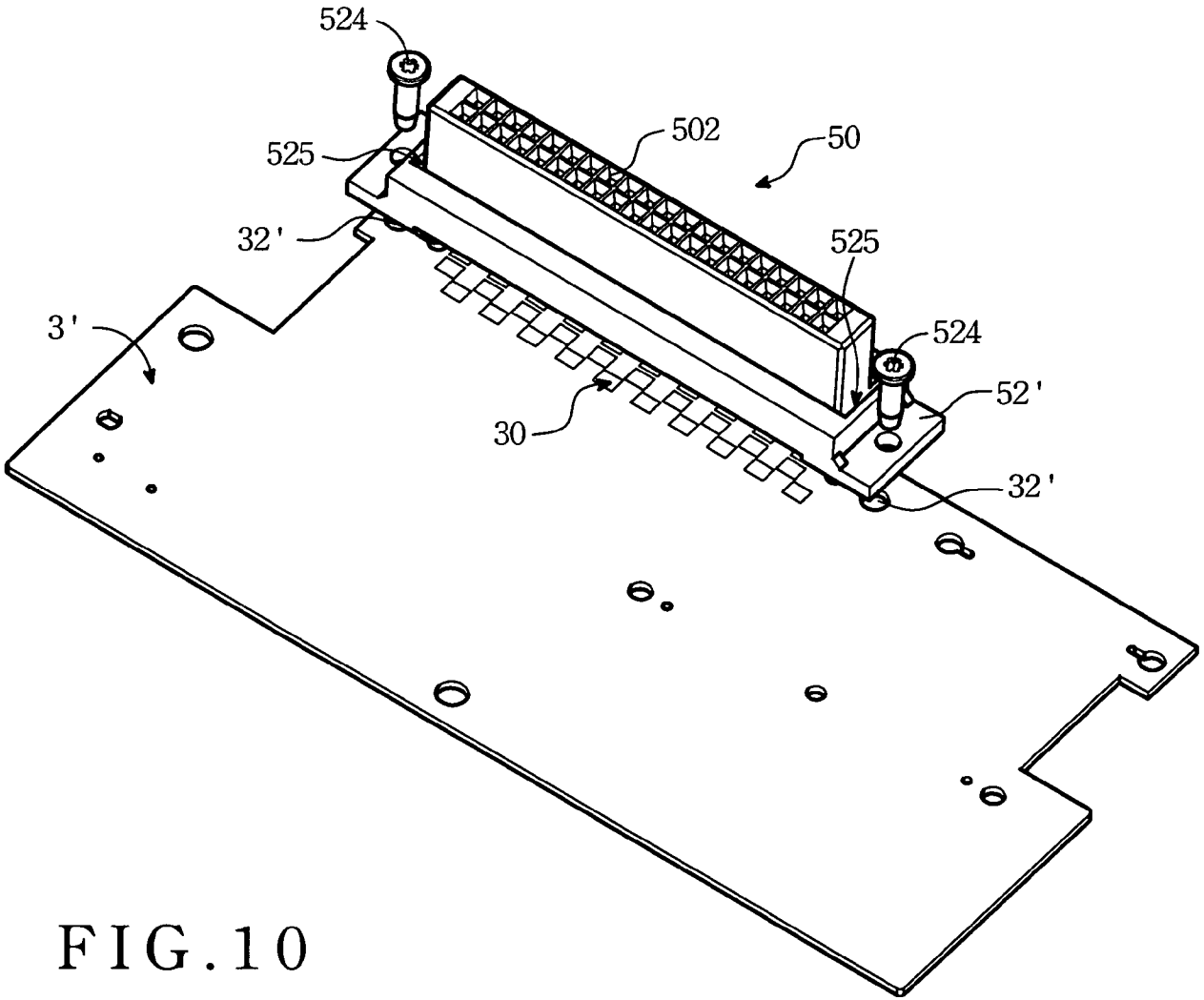
FIG. 10 shows the assembling of the adjustable connector module in the fourth embodiment of this invention.

Since the size of the opening 521 of the frame 52' is greater than that of the adjustable connector 50 and slightly smaller than that of the wing portion 501, the wing portion 501 is within the frame 52' and the adjustable connector 50 is through the opening 521, when the frame 52' is fixed on the circuit board 3'. Refer to FIG. 10, showing the adjustable connector 50 sleeved by the frame 52'. Screws 524 are screwed into the tapped holes 523 of the frame 52' and corresponding tapped holes 32' of the circuit board 3' in turn to effectively lock the frame 52'. Moreover, since a gap 525 exists between the frame 52' and the adjustable connector 50, the adjustable connector 50 is allowed to move within the frame 52' in a small range.

As shown in FIGS. 9 and 10, although insertions 502 at the top surface of the adjustable connector 50 are densely arranged in two rows, corresponding pads 30 fabricated on the top surface of the circuit board 3' may be arranged in four rows. Therefore, in addition that the size of each pad 30 can be increased to widen the range of the leaf springs (not shown) at the bottom surface of the adjustable connector 50 sliding on the pads 30, the pitch between the pads 30 is increased to reduce the occurrence of short circuits.

Figure 11A:
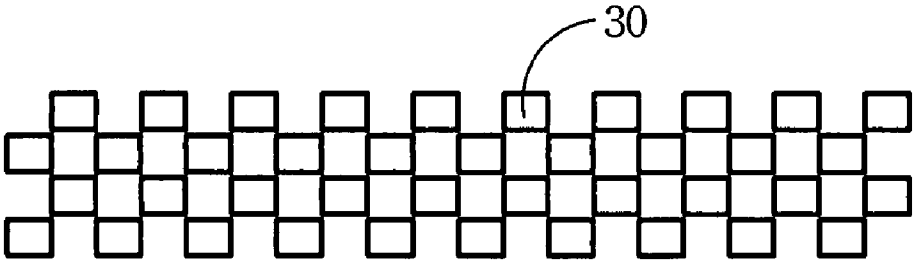
FIGS. 11A and 11B shows the arrangements of pads fabricated on the circuit board in the fourth embodiment of this invention.
Figure 11B:
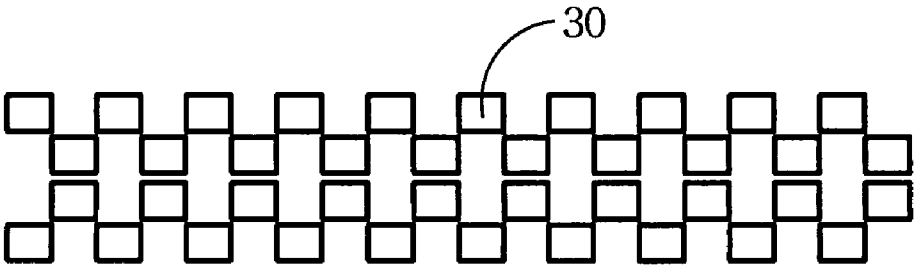

In a preferred example, the pads 30 of four rows on the circuit board 3' may be presented as the arrangement of FIG. 11A, wherein any adjacent rows are staggered, the first row and the third row of the pads 30 are aligned each other and the second row and the fourth row of the pads 30 are also aligned each other. FIG. 11B presents anther arrangement of the pads 30, wherein the first row and the second row of the pads 30 are staggered, the second row and the third row of the pads 30 are aligned each other, and the first row and the fourth row of the pads 30 are also aligned each other.

Figure 12:
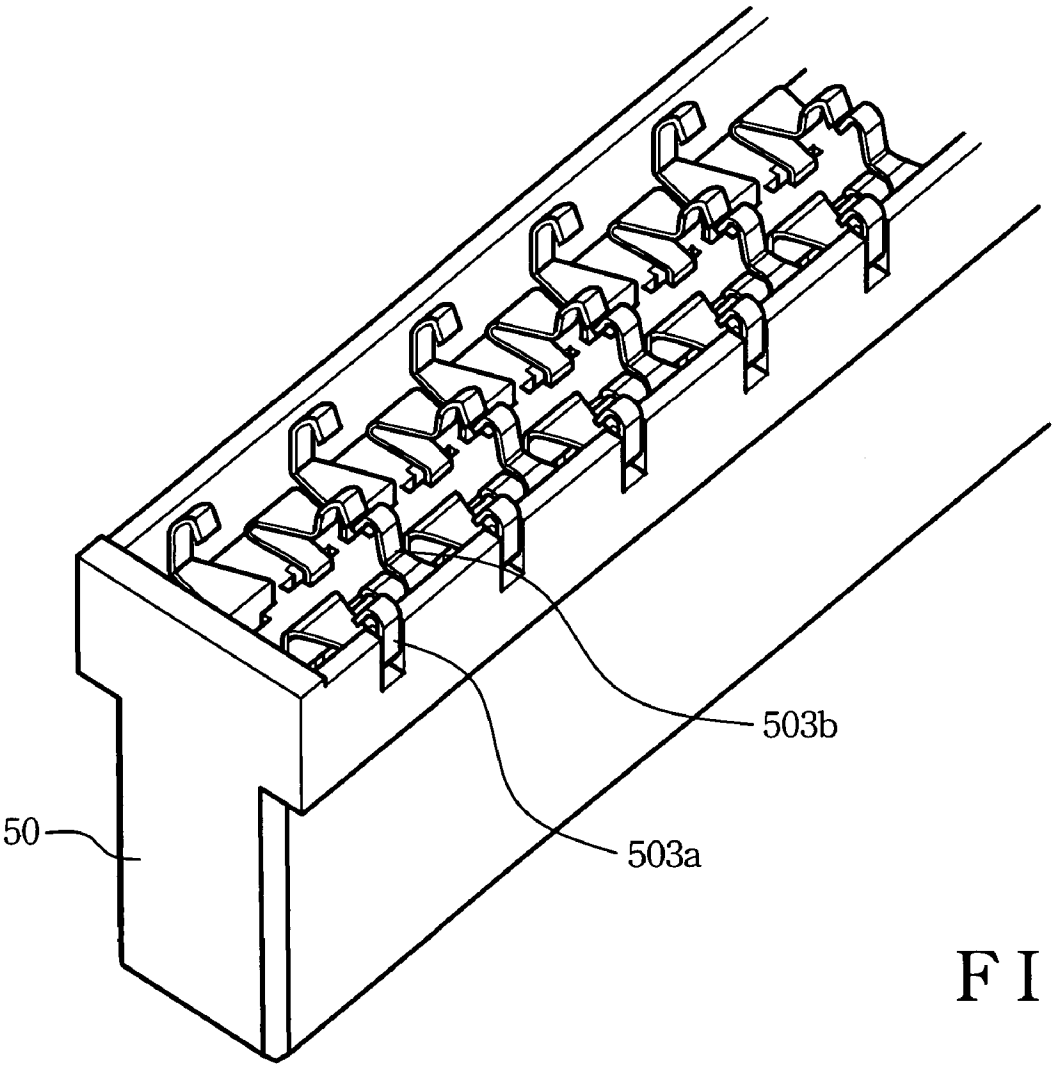
FIG. 12 shows the arrangement of the leaf springs at the bottom surface of the adjustable connector in the fourth embodiment of this invention.

In order that the leaf springs at the bottom surface of the adjustable connector 50 can well contact with the pads 30 of the four rows, the leaf springs 503 are arranged in two rows and each row of the leaf springs 503 contact with two rows of the pads 30 on the circuit board 3' and each row of the leaf springs 503 is twice the quantity of the pads 30 in each row. FIG. 12 shows the arrangement of the leaf springs 503 at the bottom surface of the adjustable connector 50 corresponding to that of the pads 30 in FIG. 11B. The leaf springs 503 corresponding to the insertions 502 at the top surface of the adjustable connector 50 are also arranged in two rows, but the odd-sorted leaf springs 503*a* in each row extend outward and the even-sorted leaf springs 503*b* in each row extend inward. When the adjustable connector 50 is placed on the circuit board 3', the leaf springs 503*a* just press against the pads 30 arranged in the first and fourth rows on the circuit board 3' and the leaf springs 503*b* just press against the pads 30 arranged in the second and third rows.

Figure 13C:
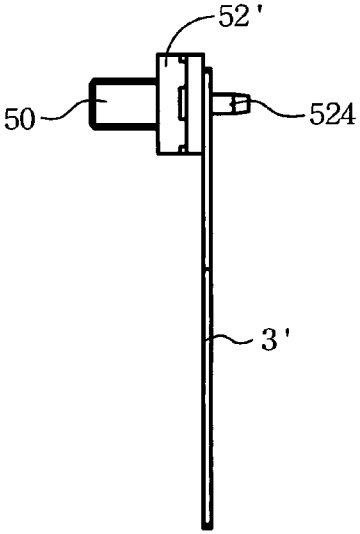
FIGS. 13B and 13C are side views of assembling the adjustable connector module onto the circuit board in the fourth embodiment of this invention.
Figure 13A:
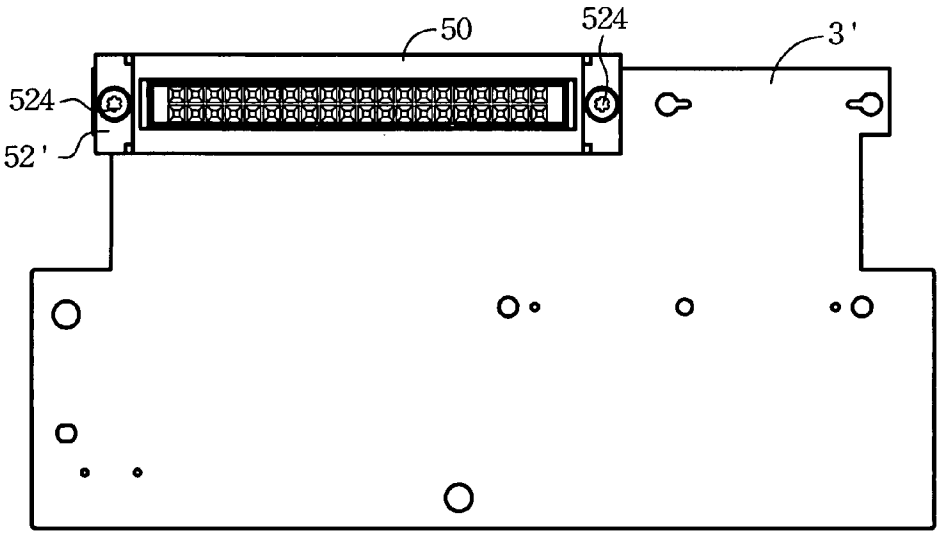
FIG. 13A is a top view of assembling the adjustable connector module onto the circuit board in the fourth embodiment of this invention.
Figure 13B:
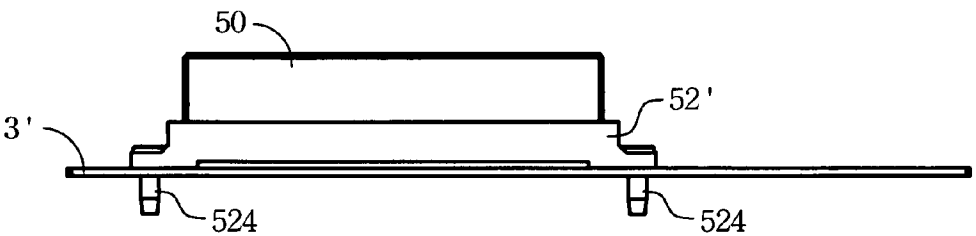

FIGS. 13A to 13C illustrates the assembling of the adjustable connector 50 onto the circuit board 3'. FIG. 13A is a top view and FIGS. 13B and 13C are side views showing that the frame 52' is locked onto the circuit board 3' by screws 524 so as to constrain the adjustable connector 50.

Figure 14:
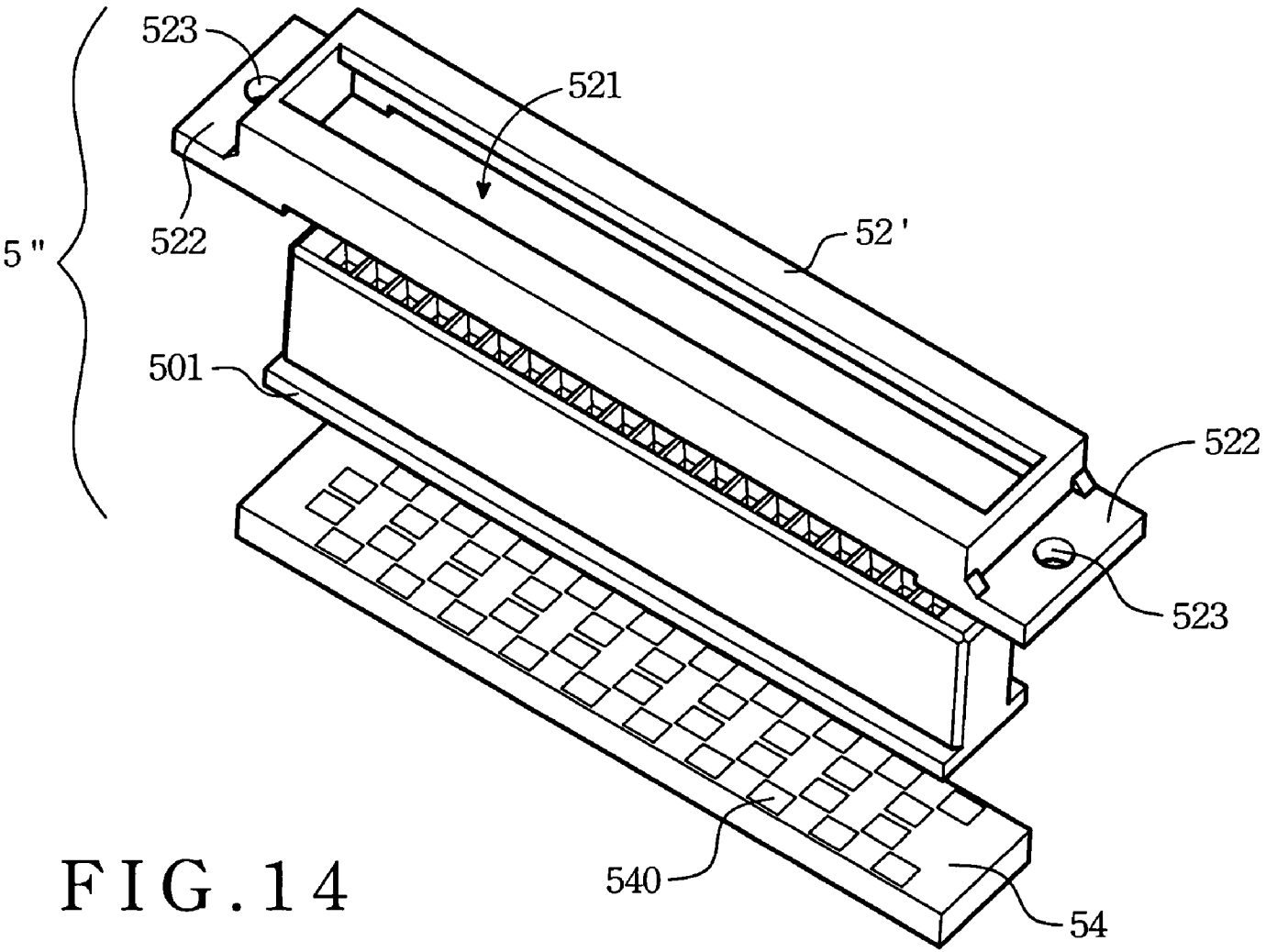
FIG. 14 is a schematic exploded diagram of an adjustable connector module in accordance with a fifth embodiment of this invention.
Figure 15:
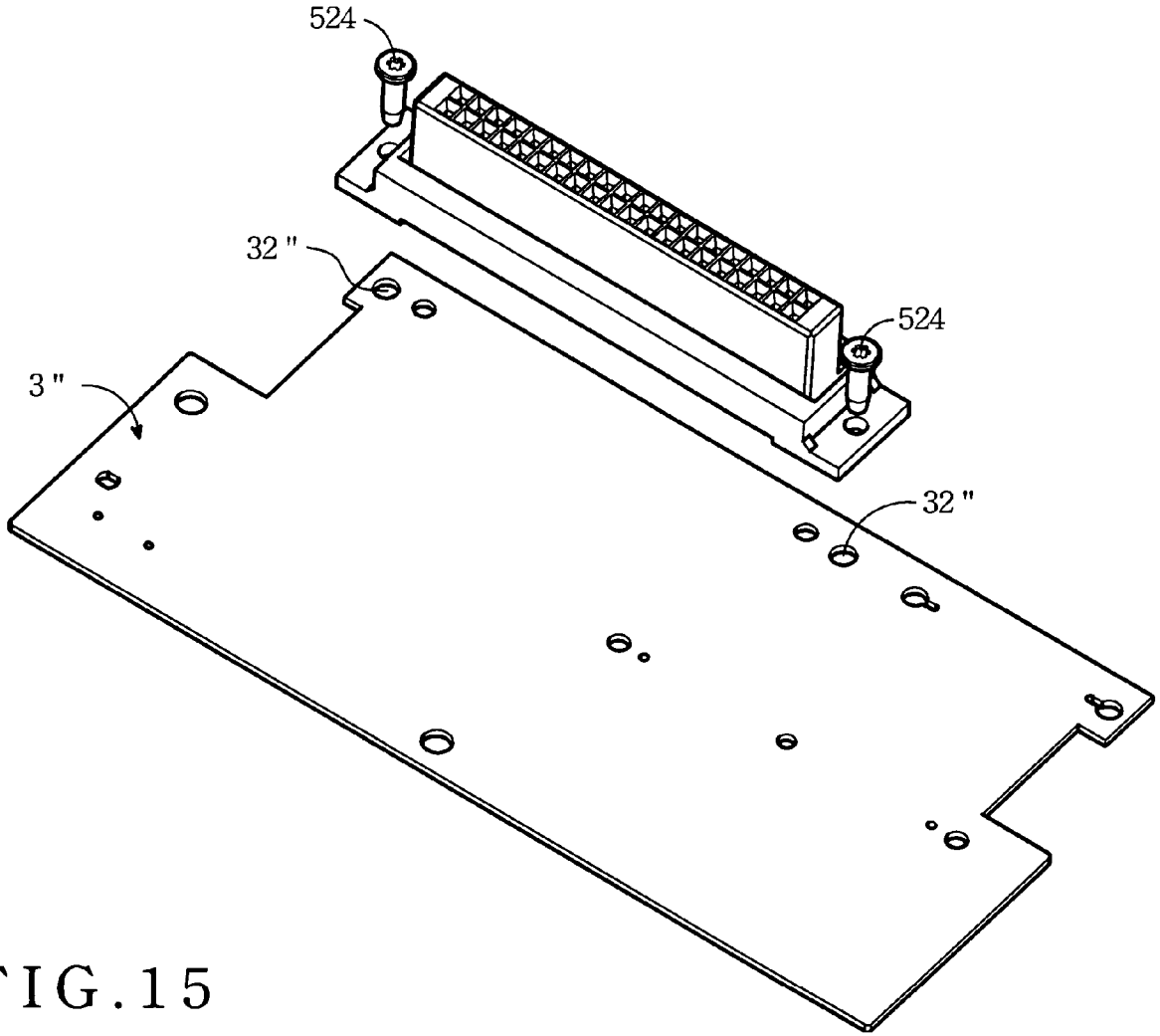
FIG. 15 shows the assembling of the adjustable connector module in the fifth embodiment of this invention.

Please refer to FIG. 14, which is a schematic exploded diagram of an adjustable connector module 5" in a fifth embodiment of this invention. The adjustable connector module 5" comprises an adjustable connector 50, a frame 52' and a bottom plate 54. A plurality of SMT pins (not shown) are fabricated at the bottom surface of the bottom plate 54 and thus may be firmly connected by soldering to corresponding contacts (not shown) on a circuit board 3" as shown in FIG. 15 when the bottom plate 54 is assembled onto circuit board 3". A plurality of pads 540 are fabricated at the top surface of the bottom plate 54 and respectively connected to the corresponding SMT pins through interconnections.

Subsequently, the adjustable connector 50 is placed on the bottom plate 54 such that the leaf springs 503 at the bottom surface of the adjustable connector 50 directly press against the corresponding pads 540 to have an electrical connection. Then, the frame 52' sleeves both the adjustable connector 50 and the bottom plate 54 to be fixed on the circuit board 3" so as to prevent the adjustable connector 50 from escaping from the bottom plate 54.

The pads 540 at the top surface of the bottom plate 54 are arranged in four rows so as to increase the size of each pad 540 and the pitch between the pads 540. The arrangement of the pads 540 may be the same as that shown in FIGS. 11A and 11B. Similarly, since the pads 540 of the bottom plate 54 correspond to the insertions 502 of the adjustable connector 50, each row of the insertions 502 is twice the quantity of the pads 540 in each row.

When the frame 52' sleeves the adjustable connector 50 and the bottom plate 54, the frame 52' may be stuck to the sidewall of the bottom plate 54 by the ultrasonic fusion technology to have the adjustable connector module 5" be assembled as shown in FIG. 15. Screws 524 are screwed into the tapped holes 523 of the frame 52' and corresponding tapped holes 32" of the circuit board 3" in turn to effectively lock the frame 52'. Moreover, since a gap 525 exists between the frame 52' and the adjustable connector 50, the adjustable connector 50 is allowed to move on the bottom plate 54 within the frame 52' in a small range.

The connecting manner provided in this invention has many advantages. First of all, several adjustable connectors can all be fabricated on one main circuit board and the position of each of the connectors can be adjusted in a small range. Hence, this invention can greatly reduce component and production costs without producing different circuit boards for each of the connectors to connect to the main circuit board by a FFC or a cable.

Furthermore, the adjustable connector of this invention takes less procedures in assembling than the prior art which takes more ten steps. For instance, only two steps are required to complete assembling in the first embodiment. The main circuit board is firstly placed on the outer frame of the modem product, and then the adjustable connector is fixed onto the outer frame by screws. In the second embodiment, three steps are required to complete assembling. The main circuit board on which the leaf spring connector has been firmly soldered is also firstly placed on the outer frame of the modem product, and then the adjustable signal connector is soldered onto the circuit transferring plate, and lastly the circuit transferring plate and the signal connector are limited onto the leaf spring connector by fastening screws. Hence, this invention apparently decreases the production cycle and thus the production cost.

In addition, the circuit transferring plate provided in this invention is an electrical transferring medium between the signal connector and the leaf spring connector. The densely arranged tiny pad patterns on the top surface of the circuit transferring plate are transferred to the less densely arranged pad patterns of larger size on the bottom surface of the circuit transferring plate so that the leaf springs will not be in contact with the neighboring pads when the signal connector is adjusted to result in short circuits. Similarly, the bottom plate provided in this invention is also an electrical transferring medium between the adjustable connector and the circuit board. The SMT pins at the bottom surface of the bottom plate correspond to densely arranged contacts on the conventional circuit board and the loosely arranged pads of larger size are fabricated at the top surface of the bottom plate such that the adjustable connector may move in a larger range and the occurrence of short circuits is reduced.

As is understood by a person skilled in the art, the foregoing preferred embodiments of the present invention are illustrated of the present invention rather than limiting of the present invention. For instance, the SMT pins 61 at the bottom surface of the leaf spring connector 6 in the embodiment can be replaced with closely arranged leaf springs. It is intended to cover various modifications and similar arrangements included within the spirit and scope of the appended claims, the scope of which should be accorded the broadest interpretation so as to encompass all such modifications and similar structure.

What is claimed:

1. An adjustable connector module assembled onto a circuit board, said circuit board having a plurality of pads for electrically connecting with said adjustable connector module, said adjustable connector module comprising:

a leaf spring connector, comprising a plurality of first pins at the bottom surface thereof firmly soldered to said plurality of pads for electrically connecting with said circuit board and a plurality of leaf springs at the top surface thereof correspondingly electrically connected with said a plurality of first pins via interconnections; and an adjustable signal connector, comprising a plurality of second pins at the bottom surface thereof against which said plurality of leaf springs correspondingly press when said adjustable signal connector is placed on the top surface of said leaf spring connector to electrically connect said adjustable signal connector with said leaf spring connector;

wherein said adjustable signal connector can keep in electrical connection with said leaf spring connector as a result of the flexibility of said plurality of leaf springs, when said adjustable signal connector makes a small movement in relation to said circuit board.

2. The adjustable connector module of claim 1, wherein said adjustable signal connector comprising a plurality of insertions at the top surface thereof correspondingly electrically connected with said a plurality of second pins via interconnections and for receiving a plurality of signal pins of a peripheral device to electrically connect said circuit board with said peripheral device.

3. The adjustable connector module of claim 1, wherein the two ends of said adjustable signal connector have a respective opening through which a fastening screw passes to delimit said adjustable signal connector on said circuit board.

4. The adjustable connector module of claim 3, wherein said fastening screw comprises a head, a shank portion and a threaded portion; wherein the diameter of said head is larger than that of said corresponding opening, the diameter of said shank portion is smaller than that of said corresponding opening, and the length of said shank portion is longer than the thickness of said corresponding opening.

5. The adjustable connector module of claim 1, further comprising a circuit transferring plate disposed between said adjustable signal connector and said leaf spring connector to electrically connect said adjustable signal connector with said leaf spring connector.

6. The adjustable connector module of claim 5, wherein said circuit transferring plate comprises a plurality of densely arranged first pin patterns at the top surface thereof at the same space as said plurality of second pins of said adjustable signal connector and a plurality of less densely arranged second pin patterns at the bottom surface thereof at the same space as aid plurality of leaf springs of said leaf spring connector.

7. The adjustable connector module of claim 6, wherein said plurality of first pin patterns are of smaller size than said plurality of second pin patterns.

* * * * *